US005815188A

United States Patent [19]

Speckhard et al.

[11] Patent Number: 5,815,188

[45] Date of Patent: Sep. 29, 1998

[54] METHOD AND APPARATUS TO REDUCE FOGGING IN ELECTROSTATIC PRINTING

[75] Inventors: Thomas A. Speckhard, Cottage Grove; Jeffrey C. Pederson, Minneapolis; Gregory G. Amell, Burnsville, all of Minn.

[73] Assignee: Minnesota Mining and Manufacturing Co., St. Paul, Minn.

[21] Appl. No.: 605,257

[22] Filed: Feb. 15, 1996

[51] Int. Cl.[6] ..... B41J 2/06

[52] U.S. Cl. ..... 347/141

[58] Field of Search ..... 347/141, 151, 347/102, 114, 153, 155

[56] References Cited

U.S. PATENT DOCUMENTS

| | | | |
|---|---|---|---|
| Re. 35,049 | 10/1995 | Atherton et al. | 346/135.1 |
| 4,290,076 | 9/1981 | McFarland | 346/154 |
| 4,297,715 | 10/1981 | Tadauchi et al. | 347/144 |
| 4,436,491 | 3/1984 | Ohnishi et al. | 346/155 |
| 4,734,788 | 3/1988 | Emmett et al. | 358/300 |
| 4,965,137 | 10/1990 | Ruf | 428/432 |
| 5,055,862 | 10/1991 | Hansen et al. | 346/154 |
| 5,138,349 | 8/1992 | Casey et al. | 347/125 |
| 5,144,343 | 9/1992 | Oba et al. | 347/55 |
| 5,192,613 | 3/1993 | Work, III et al. | 428/363 |
| 5,269,970 | 12/1993 | Ruf et al. | 252/518 |
| 5,576,742 | 11/1996 | Abe | 346/150.1 |
| 5,659,344 | 8/1997 | Kagayama | 347/55 |

FOREIGN PATENT DOCUMENTS 0 405 424 A2 1/1991 European Pat. Off. ..... G03G 15/044

OTHER PUBLICATIONS

Operations Manual for Series 5800 Electrostatic Plotter, the CalComp Corp., pp. 2–20 (Aug. 1986).

Versatec Field Upgrade Instuctions for CE3000 Series Paper Background Reduction Kit, Publication No. 5654, Ed. 1, pp. 1–6 (Oct. 1989).

*Primary Examiner*—Matthew V. Nguyen

*Attorney, Agent, or Firm*—Gary L. Griswold; John H. Hornickel

[57] ABSTRACT

A method and apparatus to reduce fogging on electrostatic printing media is disclosed. A negative bias is applied to toning station(s) or vacuum station(s) of the printing apparatus with isolation of that negative bias from the printing media.

14 Claims, 5 Drawing Sheets

METHOD AND APPARATUS TO REDUCE FOGGING IN ELECTROSTATIC PRINTING

FIELD OF THE INVENTION

This invention relates to a method and apparatus to reduce fogging on electrostatic, dielectric printing media.

BACKGROUND OF THE INVENTION

An artifact known as "fogging" can occur when printing film media in electrostatic printers and plotters.

Electrostatic color printers or plotters operate by passing a print medium, e.g., specially-coated paper or plastic film, across one or more charging heads. The charging heads apply a negative charge to the print medium in the pattern of the desired printed image. Subsequently, a liquid toner is applied to the print medium and the toner adheres to the negative charged patterns. Excess toner is removed by a vacuum chamber or roller.

Electrostatic printers are constructed in several ways. In a multi-pass system (e.g., an 8900 series electrostatic printer from Xerox Engineering Systems, San Jose, Calif.), a single charging head is used in association with a series of toner stations (typically four for the colors, yellow, cyan, magenta, and black). In the multi-pass system, print medium is transported across the charging head and then one of the toner stations to apply the color toner of that particular station. The print medium is then rewound and passed across the charging head and a different toner station for each color to be applied to the print medium.

Another electrostatic printer is the single-pass printer (e.g., a Scotchprint™ Model 9512 from 3M, St. Paul, Minn.). In the single-pass system, the printer has charging heads associated with each of the toner stations. The print medium is then passed across each pair of charging heads and toner stations to apply all of the colors. Another example of the single-pass system is found in U.S. Pat. No. 4,734,788.

In both types of electrostatic printers, single-pass and multi-pass, the same basic design criteria apply, including the speed of printing, toner optical density after printing, residual voltage or charge on the print medium, and media compatibility. In the past, electrostatic printers were used primarily in engineering applications where relatively low print speeds were acceptable. However, electrostatic printers are now being used in a wider variety of applications and customers are demanding faster printing speeds, typically measured in inches per second. An increased printing speed impacts the other design criteria, including necessary toner density, residual voltage requirements, and media compatibility.

During the electrostatic writing process, the negative charge is applied to the surface of a dielectric media, which will be subsequently toned with positively charged toner particles to form a visible image. It is necessary to have an equal negative charge flow out of the conductive layer of the dielectric media to ground. Normally, grounding for paper or other volume conductive media occurs via a path to ground through the back side of the conductive media.

With dielectric media that are not volume conductive, the path to ground must be supplied to the edges of the film medium. It is known in the art to supply special conductive stripes that are in contact with the conductive layer underneath the dielectric layer, the top surface of the film.

This path to ground via the edges of the media is sufficient for printing with low writing currents (e.g., line drawings) but not for high solid fill media, especially in the center of a wide film medium used for large format graphics, because the path to edge ground is much longer.

When the path to edge ground is insufficient, excess negative charge in the conductive layer underneath the dielectric layer appears over the toning fountain (including vacuum channels) before it can be effectively grounded out to the edges. When the excess negative charge appears over the toning fountain either by the charge spreading out in the conductive layer or in the relative movement of the media to the printing apparatus, the positively charged toner particles are attracted to the excess negative charges in the conductive layer. This can also happen with paper or other volume conductive media if the volume conductivity is insufficient or the path to ground is interrupted.

The image artifact of "fogging" results.

Also known as "film ghosting", this artifact was attempted to be addressed by the disclosure of U.S. Pat. No. 5,055,862 (Hansen et al.). Hansen et al. describe a method and apparatus that use films with the special conductive stripes at the media edges and the application of a positive charge to bias the conductive layer away from any negative charge, neutralizing the possibility of fogging on the media. Furthermore, Hansen et al. include pre-calculation of the amount of positive current bias to apply using a combination of the amount of data being written to the media and the speed of the media movement.

Hansen et al. also discloses the possibility of biasing the toner fountains negatively while keeping the film stripes at ground to reduce or eliminate fogging but note that it has the drawback of reducing the print optical density because the negative potential on the toner fountain will be in contact with the conductive stripes which will cause the conductive layer to be biased negatively, thereby reducing image density. Hansen et al. also note negative biasing can give rise to safety considerations due to the possibility of the risk of electrical shock to the operators being increased.

Another skilled in the art has disclosed the negative biasing of toner fountains. In an Operation Manual published in 1986 for its Series 5800 Electrostatic Plotter, the CalComp Corporation provided an option to bias negatively the toner fountains to reduce the possibility of fogging.

SUMMARY OF THE INVENTION

This present invention solves the control of the fogging problem in a manner that does not unduly reduce print optical density and can use electrostatic printing media that have conductive stripes or rely on path to edge ground.

One aspect of the invention is an antifogging apparatus for an electrostatic printers, comprising a power supply, means for applying voltage from the power supply to at least one station in the electrostatic printer, and means for electrically isolating printing media from at least one toner station.

Another aspect of the invention is a method for reducing fogging in an electrostatic printer, comprising the steps of applying voltage to at least one station in the electrostatic printer; and electrically isolating printing media from at least one toner station.

One advantage of the apparatus and method of the present invention is that they solve fogging problems without requiring unique electrostatic printing media.

Another advantage is that the apparatus of the present invention can be added to existing electrostatic printers or plotters or incorporated into new printers or plotters without excessive effort or cost.

Another advantage of the method and apparatus of the present invention is that the printing equipment can operate at acceptable speeds without undue fogging on the printing medium.

Further advantages of the invention are found in the embodiments of the invention, described with reference to the following drawings.

EMBODIMENTS OF THE INVENTION

Figure 1:
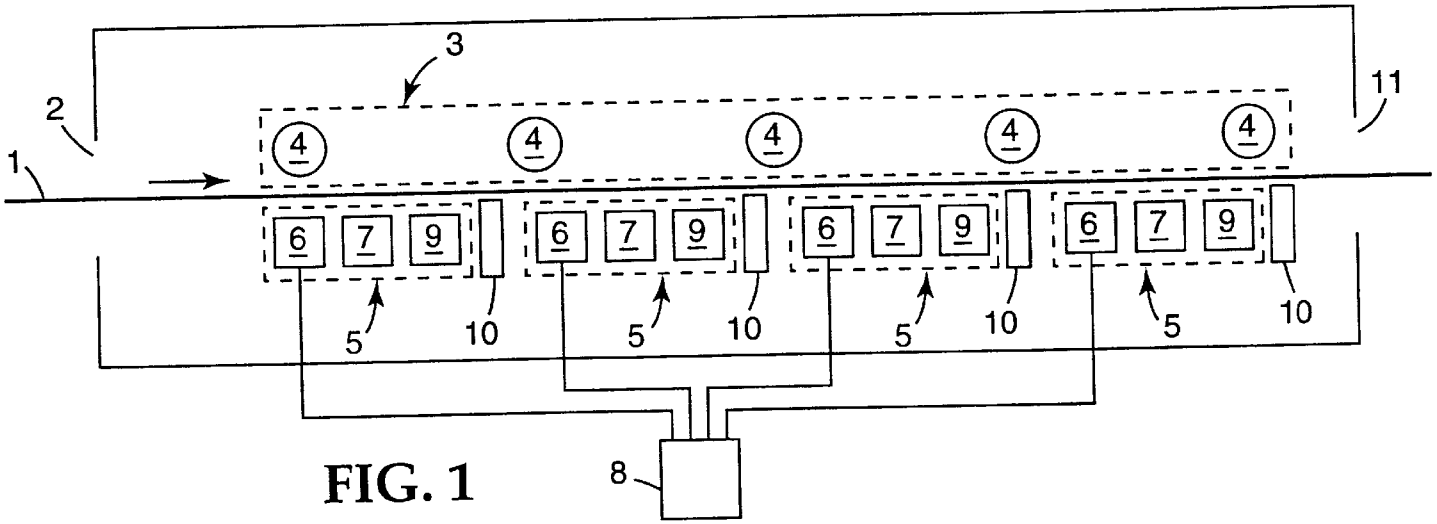
FIG. 1 is a block diagram of a single-pass printer from a side perspective.

FIG. 1 is a block diagram of a single-pass printer from a side perspective. Print medium 1 enters the printer via inlet 2. Print medium 1 is directed through the printer by a transport assembly 3. As shown in FIG. 1, transport assembly 3 typically comprises a series of rollers 4 and associated lateral guides (not shown). The print medium is transported across consecutive printing stations 5. Each printing station includes an electrostatic charging head 6 and toner station 7. In a printer that applies the four basic colors (cyan, magenta, yellow, and black), there are four printing stations 5, each station applying one of the four colors to the print medium.

Each of the charging heads 6 are programmed by controller 8. Controller 8 determines the precise pattern of charge applied by each charging head 6 to the print medium 1.

Each toner station 7 may also include a toner removal device 9, which may include a vacuum system, a scraper, and/or roller. Additionally, a drying assembly 10 may be positioned along the print medium path after each printing station 5. Drying station 10 may include a compressed air or cross-flow fan.

After passing across all of the printing stations, the print medium exits the printer at outlet 11.

Figure 2:
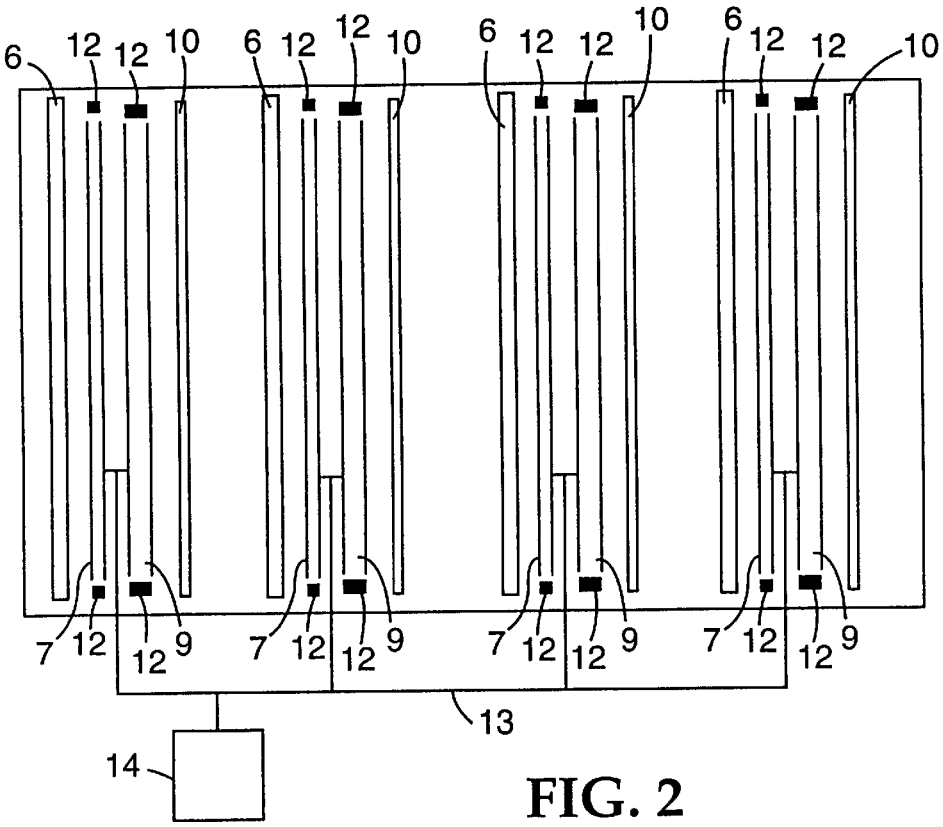
FIG. 2 is a block diagram of a single-pass printer from a top perspective.

As seen in FIG. 2, a block diagram from the top perspective, the apparatus of the present invention is added to at least one, and possibly all four, of the toner stations 7 and toner removal devices 9 to reduce fogging.

Apparatus comprises insulators 12 introduced at the terminii of toner station(s) 7, if the width of station(s) 7 exceeds the width of medium 1, and toner removal device(s) 9. Insulators can be made of any material that electrically insulates print medium from a toner station 7. Nonlimiting examples of insulators are high abrasivity, nonconductive thermoplastic polymers (such as Delrin polymer commercially available from DuPont of Wilmington, Del.); polytetrafluoroethylene; high molecular weight polyethylene; and the like.

The size of insulators 12 should be large enough to prevent the width of print medium 1 from contacting any portion of a toner station 7 between insulators 12.

Electrically connected to each toner station 7 upon which there are insulators is an electrical wire 13, or wires if it is preferred to provide a different amount of negative bias to different toner stations 7. Wire 13 should have a gauge that can accommodate from about 0 volts to about 50 volts and less than 10 mAmps. Preferably, wire 13 has a gauge ranging from about 30 to about 12 gauge. The electrical connection to each toner station 7 can be made by screw fastener, rivet, soldering, crimp lock electrical fastener, and the like.

Wires are electrically connected to a power console 14, which contains sufficient electrical or electronic circuitry to provide negative bias to each toner station 7 as desired.

Figure 3A:
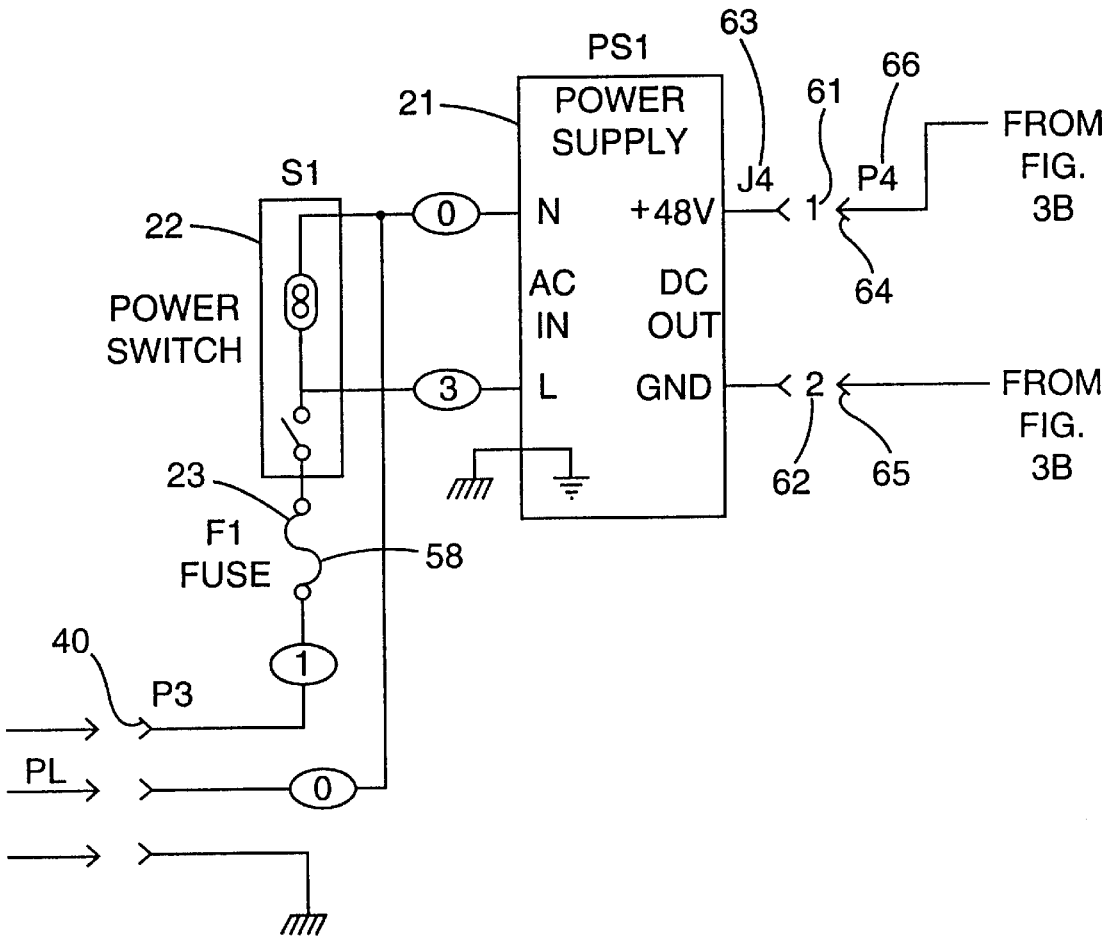
FIG. 3 is an electrical schematic of the apparatus of the present invention.
Figure 3B:
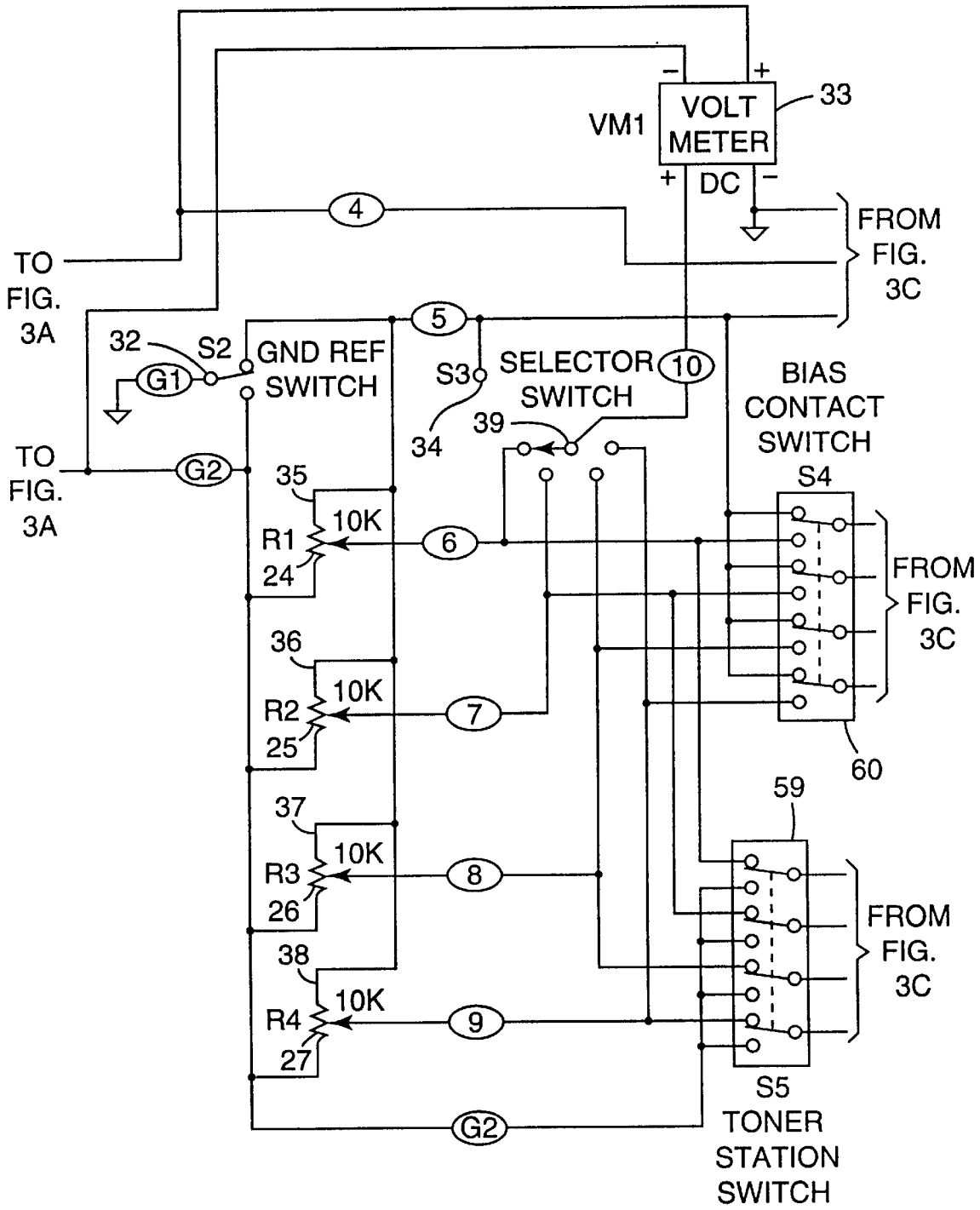
Figure 3C:
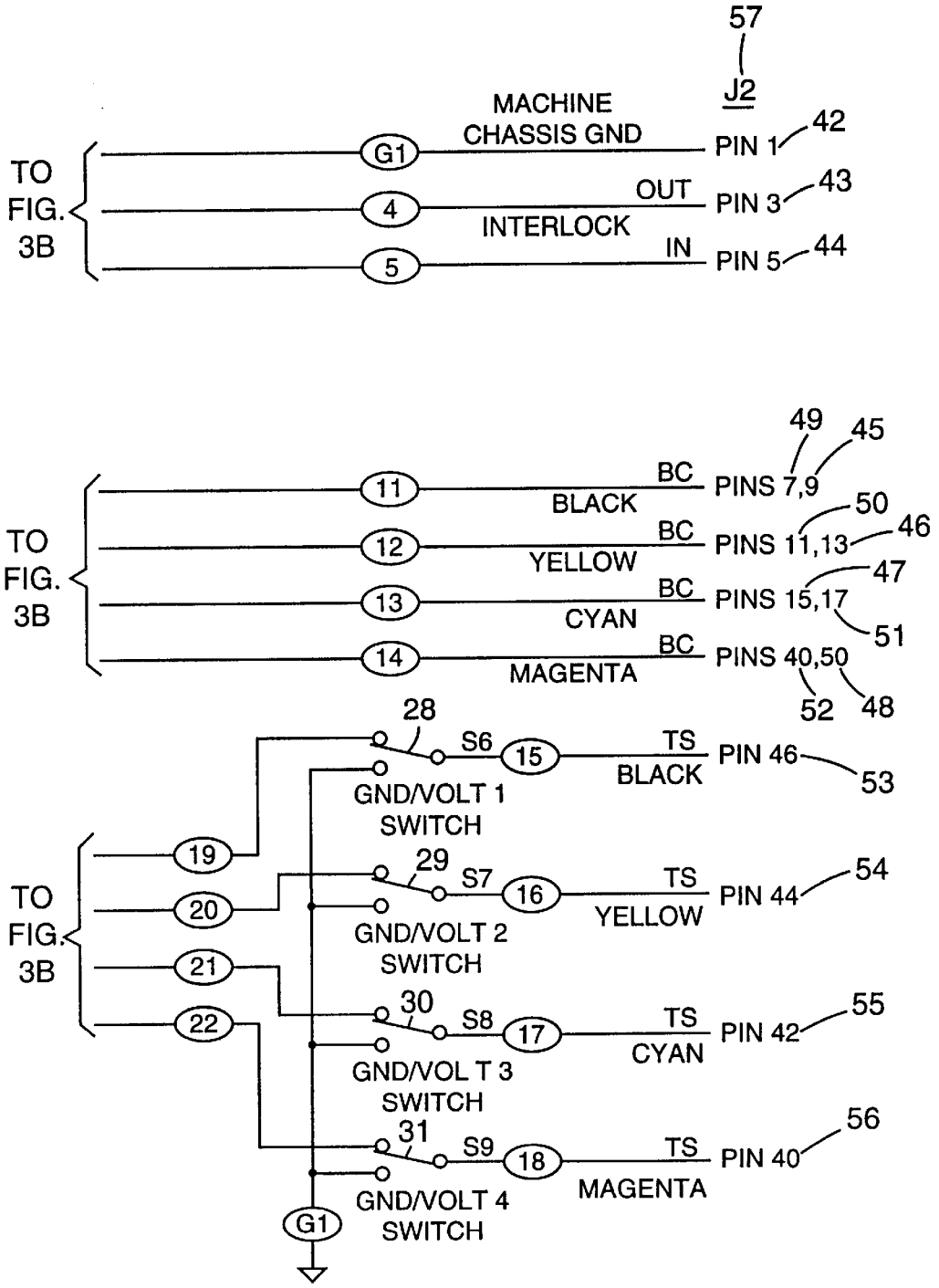

FIG. 3 is an electrical schematic of one embodiment of the power console 14. Console 14 has sufficient circuitry to provide for adjustable Direct Current voltage to any of toner stations 7 that are desired to be negatively biased, with the same or different amounts of negative bias. Since the bias voltage should be set at the minimum needed value to reduce the amount of optical density loss, it is likely that in many cases the amount of voltage needed to significantly reduce fogging will vary significantly from one color to the next not just because of different amounts of data being written in each color but because of differences in the voltage applied for each color (often different to obtain desired density) or because of differences in toner characteristics.

Further console 14 is configured to permit the grounding of toner stations 7 in the event that a printing medium 1, one that does not require such negative biasing to prevent fogging, is desired to be printed electrostatically.

Printing medium 1 that particularly benefits from the antifogging apparatus of the present invention is a polymeric medium, such as that disclosed in U.S. Pat. Nos. Re. 35,049 (Atherton et al.); 4,965,137 (Ruf); 5,192,613 (Work, III et al.); and 5,269,970 (Ruf et al.); and copending, coassigned U.S. patent application Ser. No. 08/581,324, the disclosure of which is incorporated by reference herein. Of these media, the direct print vinyl medium disclosed in the pending application is preferred.

Figure 4:
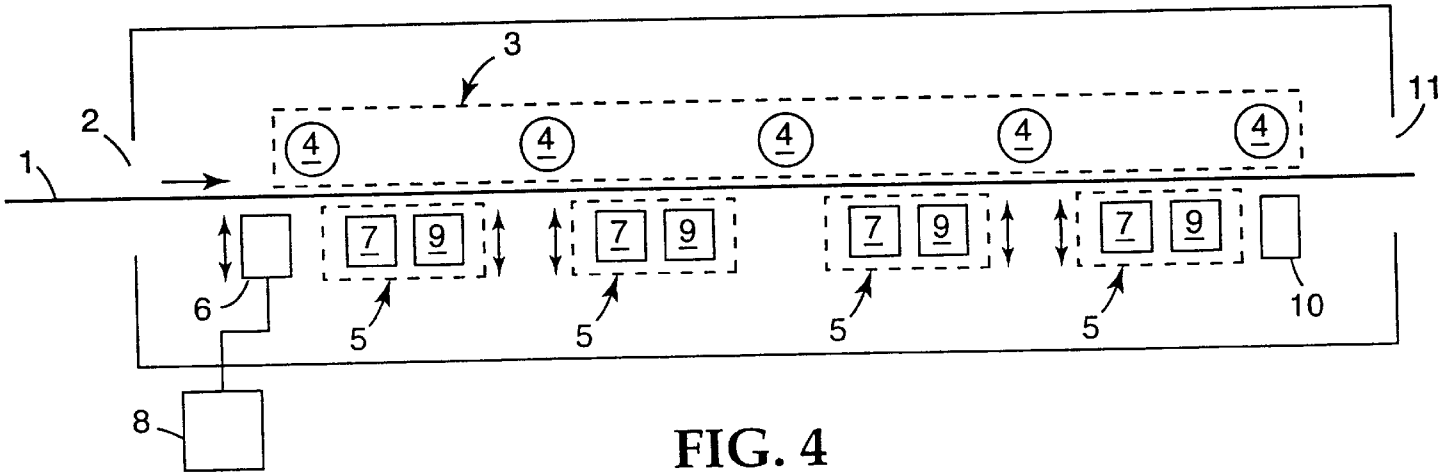
FIG. 4 is a block diagram of a multi-pass printer from a side perspective.

The present invention may also be implemented in a multi-pass printing system as shown in FIG. 4. Once again, print medium 1 enters the printer via inlet 2. Transport assembly 3 moves the print medium through the printer. A single charging head 6 is positioned upstream from the printing stations 5. Transport assembly 3 moves the print medium 1 across the charging head 6, then one of the printing stations 5 to apply the toner color of that station, and the drying assembly 10. Transport assembly 3 then directs print medium 1 back across charging head 6, then across another printing station 5 and drying assembly 10 until all colors have been applied to print medium 1.

Typically, charging head 6 and printing stations 5 are retractable as shown by the arrows in FIG. 2. The printing stations 5 remain in the lower position until the toner color of a station is to be deposited on medium 1, then that station is moved upward toward print medium 1. When subsequent charges are to be applied to print medium 1, charging head 6 is lowered and print medium 1 is directed upstream of charging head 6. Charging head 6 is then raised and the desired charge is applied to print medium 1 as it moves downstream across charging head 6.

The printing stations 5 of the multi-pass printer include a toner station 7 and toner remover 9 as described above for the single-pass printer. Also, a single drying assembly 10 is typically positioned after the last printing station.

Figure 5:
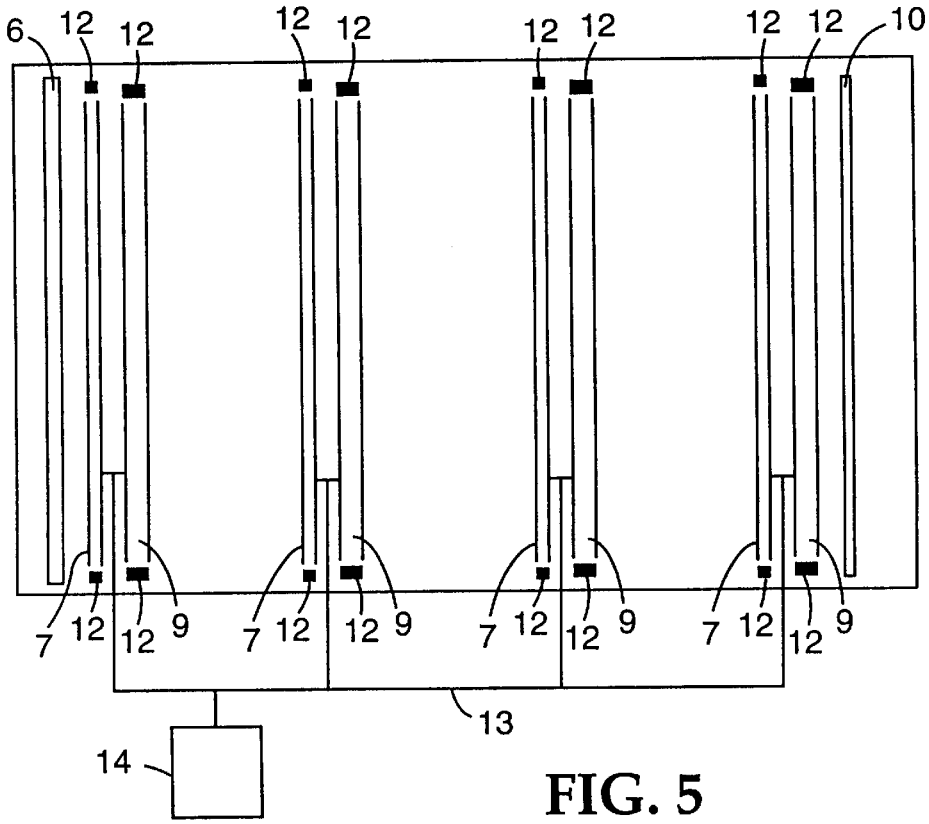
FIG. 5 is a block diagram of a single-pass printer from a top perspective.

FIG. 5 is a block diagram of the second embodiment from a top perspective. As in FIG. 2, insulators 12 are provided at terminii of one or more toner stations 7, connected by electrical wire 13 to power console 14.

The range of negative biasing of a toner station 7 can range from about 0 to about 50 volts and up to 10 mAmps and is quite dependent on characteristics of the media, printer speed, the amount of data written, and the like. Preferably, the range of negative biasing of a toner station 7 can range from about 1 to about 30 volts and up to about 1 mAmp. Presently with vinyl media publicly announced to be marketed as Scotchcal™ ES 3651-10 from 3M Company of St. Paul, Minn., from about 10 to 15 volts should be applied. Determination of the appropriate amount of voltage occurs through limited trial and error.

Insulators 12, wire 13, and power console 14 can be installed in new equipment or retrofitted into existing electrostatic printing equipment, such as a Scotchprint Model 9510 or 9512 printer commercially available from 3M Company of St. Paul, Minn. Depending on whether the printer is designed for one or multiple passes for electrostatic imaging, either the embodiments of FIGS. 1–2 or 3–4 can be employed.

Modification of the 9510 printer can employ the use of nonconductive parts (plastic parts) as insultators 12 in terminal areas of devices 9 that would otherwise contact the edge strip of printing medium 1. Modification of the 9512 printer devices 9 can employ mechanical milling in the terminal areas in order to avoid the web path of the conductive stripes on the printing medium 1.

Furthermore, with the apparatus of the present invention, it may only be necessary to conductive stripes from medium 1 from the toner station 7 or toner removal device 9 of the last color of the single pass printer.

Despite the disclosure of Hansen et al. concerning the safety of negative biasing of the printing equipment, the method and apparatus of the present invention does not provide any undue safety or electrical compliance concerns, particularly because by isolating the stations 7 or devices 9 or just the last station 7 or device 9, there will be almost no current traveling along the conductive layer in the printing medium 1 out of the medium 1. Alternatively, one can put additional grounding contacts (not shown) after the last station 7 or device 9 to ground out any residual current before the medium 1 leaves the outlet 11, thereby providing an additional safety margin if such concerns arose.

Further, preferably, for retrofitting Models 9510 and 9512 printers, one can provide grounding contacts (not shown) after each electrostatic charging head 6 on opposing ends in a Model 9510 or 9512 printer that are mechanically designed to maintain a pressure contact yet do not allow the printing medium 1 to be "caught" underneath the contact when the medium is moving from inlet 2 to outlet 11 to avoid a transport problem called "vacuum outs". An alternate method of grounding is to build contact points directly into the electrostatic charging head 6 itself.

Further with respect to retrofitting a 9510 printer, one can use nonconductive screws to bolt the toning station 7 and device 9 to the frame of the printer and have placed electrically insulating tape (commercially available as No. 1350 Scotch™ electrical tape from 3M Company of St. Paul, Minn.) between the frame of the toning station 7 and the overall frame of the printer. This provides an effective isolation of the toning and vacuum stations, 7 and 9 respectively, with only a high impedance (10 MOhm) path to ground through the "squirrel cage" drying fan motors (not shown).

In the presently preferred method of antifogging, a constant direct current negative bias is applied to the toner stations 7 and toner removal devices 9 while grounding the edge conductive stripes of the printing medium 1 with contacts near the electrostatic charging heads 6 and providing means 12 to isolate the edge stripes from the toning station(s) and device(s) 9.

The apparatus of the present invention overcomes the detrimental effects of positive biasing such as increased spurious writing and apparently the necessity of isolating all vacuum stations and probably the front guide bar. Furthermore, the use of negative biasing can also reduce or eliminate other artifacts such as backgrounding etc. that can occur on all media including volume conductive media such as paper.

The invention is not limited to the above embodiments. For example, the power console and wires can be configured to connect to other portions of electrostatic printers to provide either positive or negative biasing voltage as the case requires. However, negative biasing of toner station(s) 7 and toner removal device(s) is preferred because:

1. Positive biasing of the edge conductive stripes and conductive layer of the dielectric printing media increases the amount of nib writing. This artifact is not mentioned in the Hansen et al. patent but does occur. It is believed that increasing the potential of the conductive layer of printing medium 1 will increase the chances of electrostatic writing when a writing stylus (nib) is in the "on" state and the corresponding shoe plate is in the "off" state.

2. Positive biasing can cause unwanted toner staining. Hansen et al. disclose that the conductive stripes are in contact with the toner station and that under negative bias, this leads to reduced density and the possibility of shocking the operator. However, with positive biasing of the conductive stripes of the dielectric printing media, the toner station can have a slight positive potential which can thereby cause deposition of positive charged toner particles into non-charged areas of the media resulting in unwanted toner stains.

3. With a direct current bias approach there is a loss of print density with either the positive film stripe biasing as disclosed in the Hansen et al. patent or with negative toner station biasing as disclosed in the present invention. However, using the apparatus of the present invention, the most likely cause of density reduction is the fact that the negative potential of written charge on the dielectric layer of the media is effectively lowered by the negative potential on the toner station. In the positive bias approach disclosed by Hansen et al., the positive potential in the conductive layer of the print medium will effectively neutralize some of the negative charge on the dielectric layer of the print medium or, in an alternate view, repel some of the positively charged toner particles leading in either case to a lower field and less toner deposited. Further the pre-calculation biasing approach disclosed by Hansen et al. is disadvantaged for comprehensive anti-fogging because the charge due to fogging is not uniform across the width of the printing medium, causing over-calculation of the pre-calculation.

The following components are identified with the electrical schematic of FIG. 3.

| Number | Component | Source |
|---|---|---|
| 21 | Power Supply; GPC55-48, Switching 6.30 × 3.94 × 1.68, Single Output, 48 VDC 1.5 A 55 W 85–264 VAC 47–63 Hz Input | Condor |

-continued

| Number | Component | Source |
|---|---|---|
| 22 | Switch 1500R11E. Spst.Lighted Rocker. Red-On-None-Off, 15 A 125 VAC.UL/CSA/VDE | Arrow Part |
| 23 | Fuse Holder; 3453LF-8L for 3 AG 0.250 × 1.25 Fuses.PNL. MT, 20 A 250 V Max; Assembled with Knob UL/CSA/VDE | Littlelfuse |
| 24–27 | Potentiometer; 73 JB–10K, WW, 10-turn, 10K Ohm 5% 2 W | Clarostat |
| 28–32 | Switch; MTA-106D, SPDT, Toggle On-Off-On, 6 A @ 125 VAC; 3 A @ 250 VAC; 4 A @ 28 VDC | Alcoswitch |
| 33 | Meter; M235-0-0-14-0, Volt, LCD 3-½ Digits, 200 VDC, Input 120 VAC Operating | Simpson Electric |
| 34 | Switch; C5P0112N-A, Rotary, 1 pole 2–12 pos. with solder Lugs. 125 VAC 1 A, C5 Series | Electroswitch |
| 35–38 | Knob; 3 16-1 1, Potentiometer, 15 Turn, Digital Readout Dial, Clear Anodized Metal | Clarostat |
| 39 | Knob; P-120, Switch, ¼ Dia., Pointer with Set Screw | Electroswitch |
| 40 | Connector; 6100, 3300, Plug, 3 Terminal, AC Power Inlet; 10 A/15 A 250 VAC, UL/CSA/VDE | Schurter |
| 41 | Power Cord; 17,500, 3 CNDCT, 18 AWG × 2 meters, pre-assembled with PVC connector, black, 10 A 125 V UL/CSA | Belden |
| 42–56 | Terminal, 1-66504-0. SKT, DF-20, Loose PC, BRS, Gld/NKL, 24–20 AWG | AMP |
| 57 | Connector, 20521 1–2 RCPT D-Sub, 50 CKT, HDP-20, GL Filled Nylon 94 V-0, Tin, Blk | AMP |
| 58 | Fuse; AGC-2, Fast-Acting, ¼ × 1¼, Ferrule, Glass, 2A 250 V, UL/CSA | Bussmann |
| 59–60 | Switch; MTA-406N, 4PDT, Toggle On-None-On, 6 A @ 125 VAC; 3 A @ 250 VAC; and 4 A @ 28 VDC | Alcoswitch |
| 61–62 | Terminal, 02-09-2103, Male, Std. 0.093, CRP, BRS, Tin, 20–14 AWG, Cage 27264 | Molex |
| 63 | Connector; 19-09-2029, PL, 2 CKT Intl. 0.093 European, 3191 Ser | Molex |
| 64–65 | Terminal, 02-09-1 104, Female, Std. 0.093, Crp w/o Dimple, BRS, Tin, 14–20 AWG, Loose-Piece | Molex |
| 66 | Connector; 19-09-1029, RCPT, 2 CKT Intl. 0.093 w/MTG Ears | Molex |

For an appreciation of the scope of the present invention, the claims follow.

What is claimed is:

1. An antifogging apparatus for an electrostatic printer, comprising:

(a) a power supply;

(b) means for applying voltage from the power supply to at least one station in the electrostatic printer; and (c) means for electrically isolating printing media from at least one toner station, wherein the printing media has edge conductive stripes and wherein the apparatus further comprises means for grounding conductive stripes of the printing media.

2. The apparatus of claim 1, wherein the voltage is positive and is applied to electrical contacts in electrical communication with edge conductive stripes on the printing media.

3. The apparatus of claim 1, wherein the voltage is negative and is applied to at least one toner station.

4. The apparatus of claim 1, wherein the voltage is negative and is applied to at least one toner station.

5. The apparatus of claim 1, wherein the voltage is also applied to at least one toner removal device.

6. The apparatus of claim 1, wherein the power supply comprises circuitry to adjust the amount of voltage applied to the electrostatic printer.

7. The apparatus of claim 6, wherein the circuitry comprises switches and variable resistors.

8. A method for reducing fogging in an electrostatic printer, comprising the steps of:

(a) applying voltage to at least one station in the electrostatic printer;

(b) electrically isolating printing media from at least one toner station; and (c) grounding conductive stripes of the printing media.

9. The method of claim 8, wherein the voltage is positive and is applied to electrical contacts in electrical communication with edge conductive stripes on the printing media.

10. The method of claim 8, wherein the voltage is negative and is applied to at least one toner station.

11. The method of claim 8, wherein the voltage is negative and is applied to at least one toner station.

12. The method of claim 8, wherein the voltage is also applied to at least one toner removal device.

13. The method of claim 8, wherein the power supply comprises circuitry to adjust the amount of voltage applied to the electrostatic printer.

14. The method of claim 13, wherein the circuitry comprises switches and variable resistors.

* * * * *